US006658694B2

(12) United States Patent
Wang

(10) Patent No.: US 6,658,694 B2
(45) Date of Patent: Dec. 9, 2003

(54) HINGE DEVICE WITH A RETURNING MEMBER FOR AUTOMATICALLY CLOSING AN OPEN DOOR

(75) Inventor: Yu-Jen Wang, Tainan Hsien (TW)

(73) Assignee: Fu Luong Hi-Tech Co., LTD, Tainan Hsien (TW)

( * ) Notice: Subject to any disclaimer, the term of this patent is extended or adjusted under 35 U.S.C. 154(b) by 0 days.

(21) Appl. No.: 10/104,231

(22) Filed: Mar. 22, 2002

(65) Prior Publication Data

US 2003/0177605 A1 Sep. 25, 2003

(51) Int. Cl.[7] ..... E05F 3/20

(52) U.S. Cl. ..... 16/50; 16/54; 16/303; 16/330; 16/284

(58) Field of Search ..... 16/50, 54, 283, 16/284, 303, 330, 55

(56) References Cited

U.S. PATENT DOCUMENTS 3,074,101 A * 1/1963 Hideyoshi ..... 16/54
4,030,161 A * 6/1977 Loikitz ..... 16/284
4,068,344 A * 1/1978 Okabe ..... 16/54
4,155,144 A * 5/1979 Koganei ..... 16/54
4,215,449 A * 8/1980 Loikitz ..... 16/50
4,692,963 A * 9/1987 Barroero ..... 16/275
4,756,051 A * 7/1988 Shy ..... 16/50
5,138,743 A * 8/1992 Hoffman ..... 16/303
5,152,029 A * 10/1992 Pai ..... 16/54
5,651,536 A * 7/1997 Daul ..... 267/205
5,855,040 A * 1/1999 Lin ..... 16/50

FOREIGN PATENT DOCUMENTS

JP 11-343769 * 12/1999

* cited by examiner

*Primary Examiner*—Chuck Y. Mah
(74) *Attorney, Agent, or Firm*—Ohlandt, Greeley, Ruggiero & Perle, L.L.P.

(57) ABSTRACT

A hinge member includes a rotatable cam element with a first cam face and a slidable cam element with a second cam face associated with the first cam face in such a manner that the second cam face moves away from the first cam face when the slidable cam element is cammed by the rotatable cam element due to an applied external force. A biasing member is connected to the slidable cam element so as to accumulate a returning force when the second cam face moves away from the first cam face and so as to urge the second cam face to move toward the first cam face when the external force ceases to be applied on the rotatable cam element.

9 Claims, 6 Drawing Sheets

HINGE DEVICE WITH A RETURNING MEMBER FOR AUTOMATICALLY CLOSING AN OPEN DOOR

BACKGROUND OF THE INVENTION

1. Field of the Invention

This invention relates to a hinge device, more particularly to a hinge device with a returning member for automatically closing an open door.

2. Description of the Related Art

A conventional hinge device generally includes a stationary hinge member that is adapted to be mounted on a door frame, and a rotatable hinge member that is adapted to be mounted on a door and that is pivoted to the stationary hinge member so as to permit rotation of the door relative to the door frame between open and closed positions.

One drawback of the aforesaid conventional hinge device resides in that the door needs to be moved manually from the open position to the closed position.

An improved hinge device has been proposed in order to overcome the aforesaid drawback, and includes a biasing member or a hydraulic device interposed between the stationary and rotatable hinge members for automatically closing an open door. However, the biasing member generally closes the door so swiftly such that banging of the door relative to the door frame may result. The hydraulic device employed in the improved hinge device may reduce the effect of banging, but includes too many components that complicate assembly and mass production of the same.

SUMMARY OF THE INVENTION

The object of this invention is to provide a hinge device with a returning member for automatically closing an open door and that is capable of overcoming the aforesaid drawbacks of the conventional hinge devices.

Accordingly, a hinge device of the present invention includes a stationary hinge member, a rotatable hinge member, a cam mechanism, and a biasing member. The rotatable hinge member is pivoted to the stationary hinge member so as to rotate about a vertical axis between open and closed positions. The cam mechanism includes a rotatable cam element that is coupled to the rotatable hinge member so as to rotate about the vertical axis together with the rotatable hinge member and that is formed with a first cam face, and a slidable cam element that is formed with a second cam face associated with the first cam face and that is movable in an axial direction along the vertical axis. The second cam face moves away from the first cam face when the slidable cam element is cammed by the rotatable cam element upon rotation of the rotatable hinge member from the closed position to the open position by an external force applied on the rotatable hinge member. The biasing member is connected to the slidable cam element so as to accumulate a returning force when the second cam face moves away from the first cam face and so as to urge the second cam face to move toward the first cam face when the external force ceases to be applied on the rotatable hinge member, thereby returning the rotatable hinge member from the open position to the closed position.

BRIEF DESCRIPTION OF THE DRAWINGS

These and other features and advantages of this invention will become apparent in the following detailed description of the preferred embodiment of this invention, with reference to the accompanying drawings, in which.

DETAILED DESCRIPTION OF THE PREFERRED EMBODIMENT

Referring to FIGS. 1 to 5, the preferred embodiment of a hinge device according to the present invention is shown to include a stationary hinge member 4, a rotatable hinge member 3, and a returning member consisting of a cam mechanism and a biasing member 75.

Figure 1:
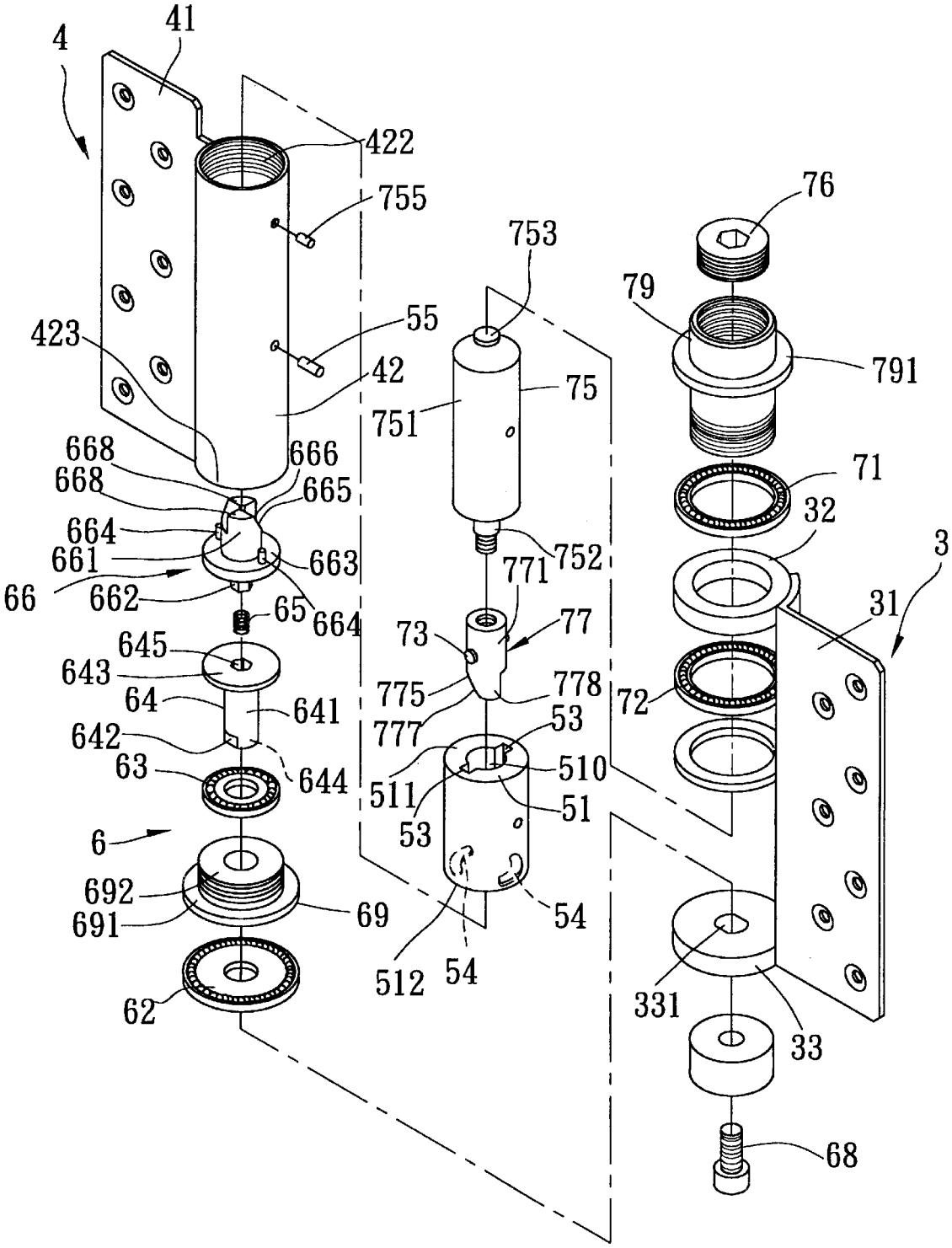
FIG. 1 is an exploded perspective view of a preferred embodiment of a hinge device according to the present invention.
Figure 2:
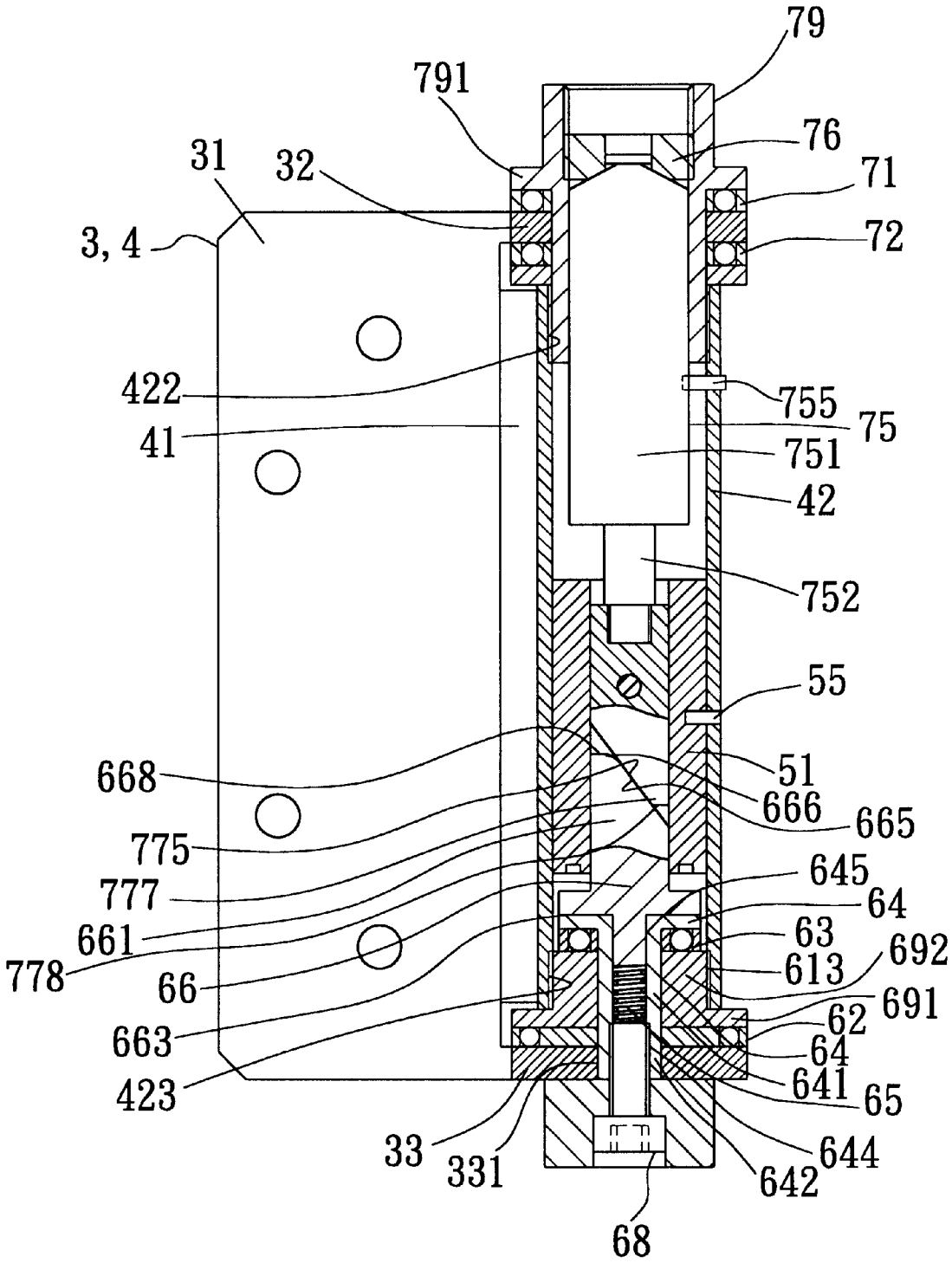
FIG. 2 is a fragmentary sectional view of the preferred embodiment, illustrating connecting relationship between rotatable and slidable cam elements employed therein when the preferred embodiment is disposed at a closed position.
Figure 3:
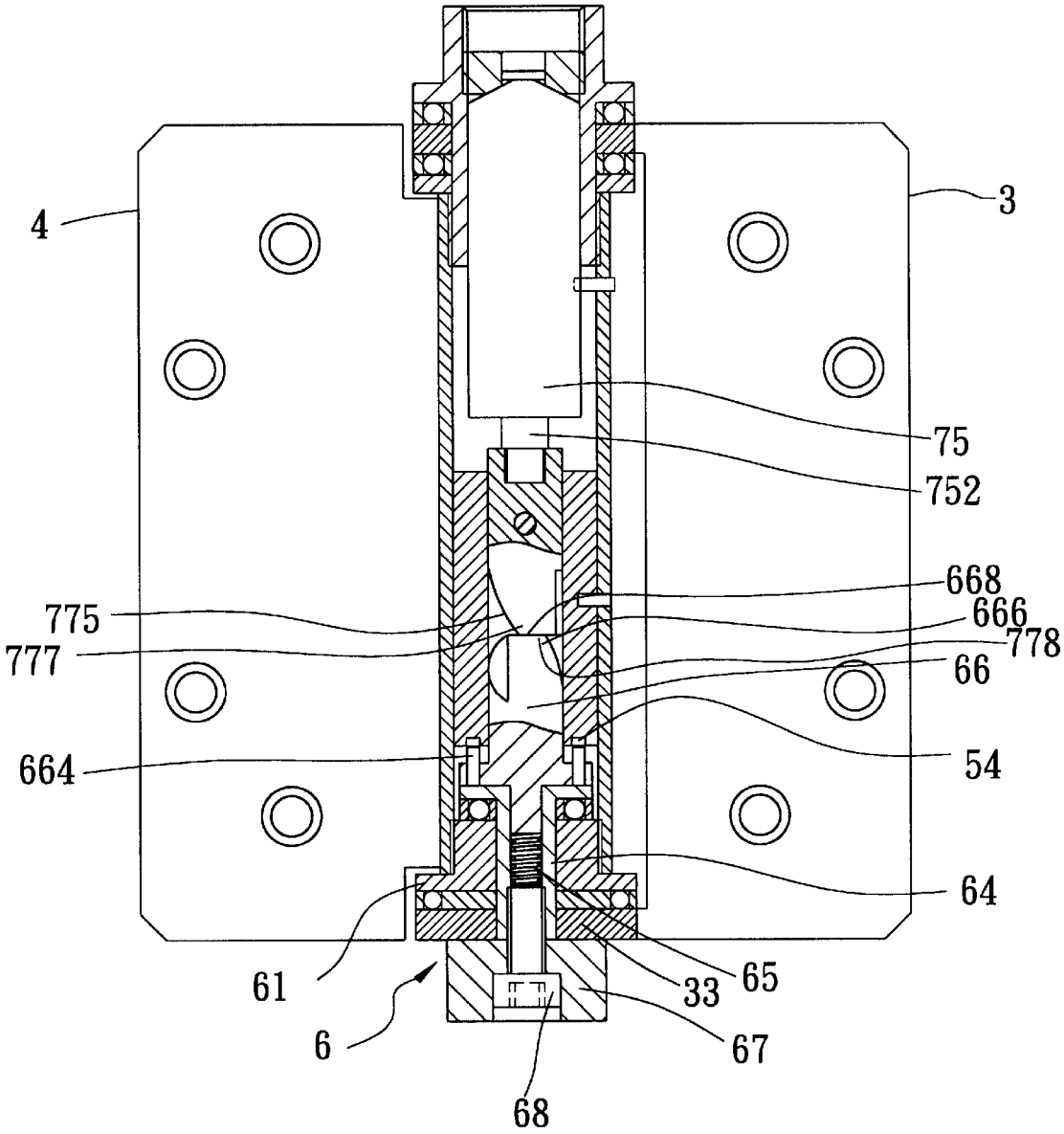
FIG. 3 is a fragmentary sectional view of the preferred embodiment, illustrating the connecting relationship between the rotatable and slidable cam elements employed therein when the preferred embodiment is disposed at an open position.
Figure 4:
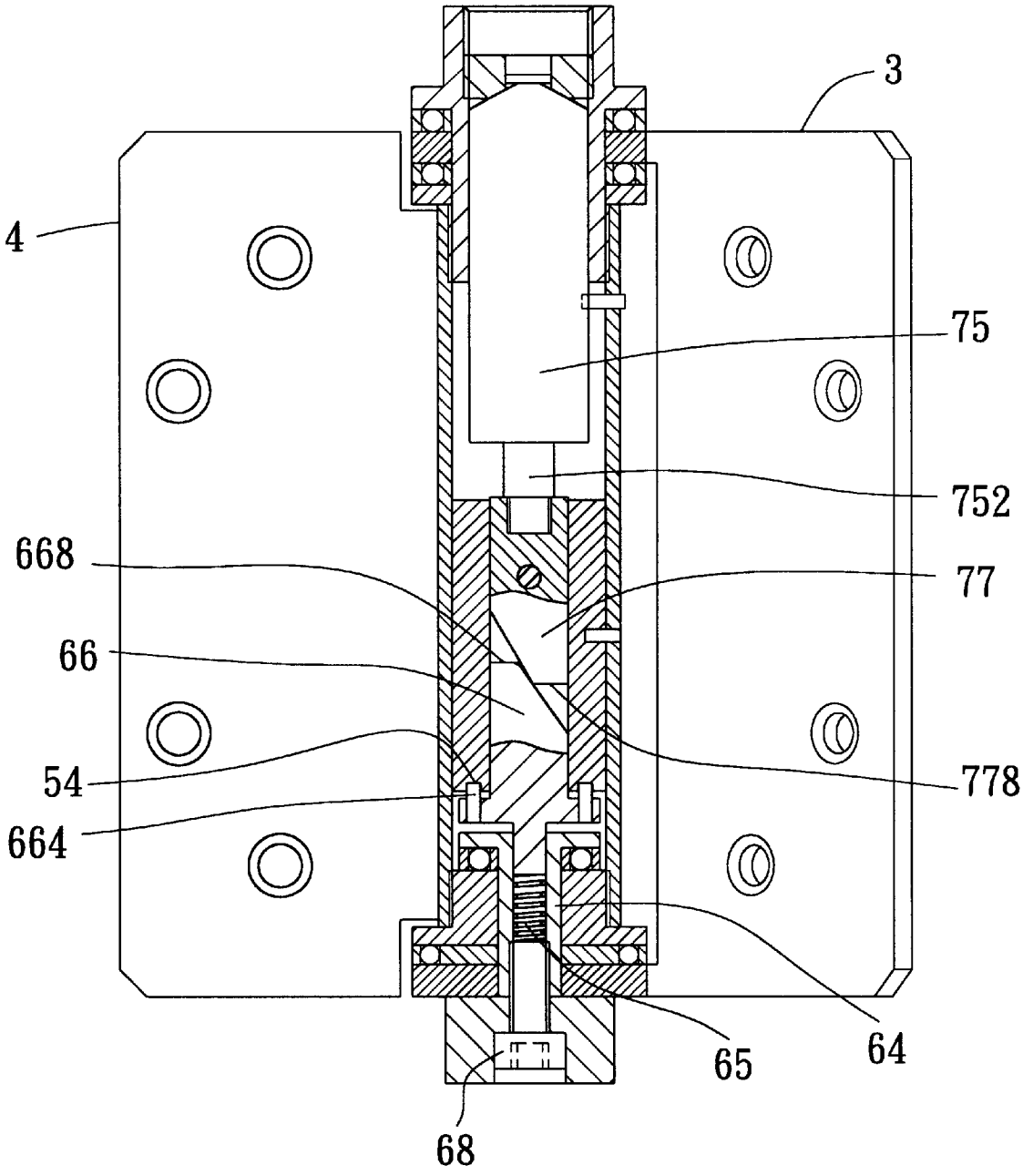
FIG. 4 illustrates how two restricting studs of the rotatable cam element extend into two restricted slots in a guide tube in order to provide a retarding action during closing movement of the preferred embodiment so as to avoid a banging action.
Figure 5:
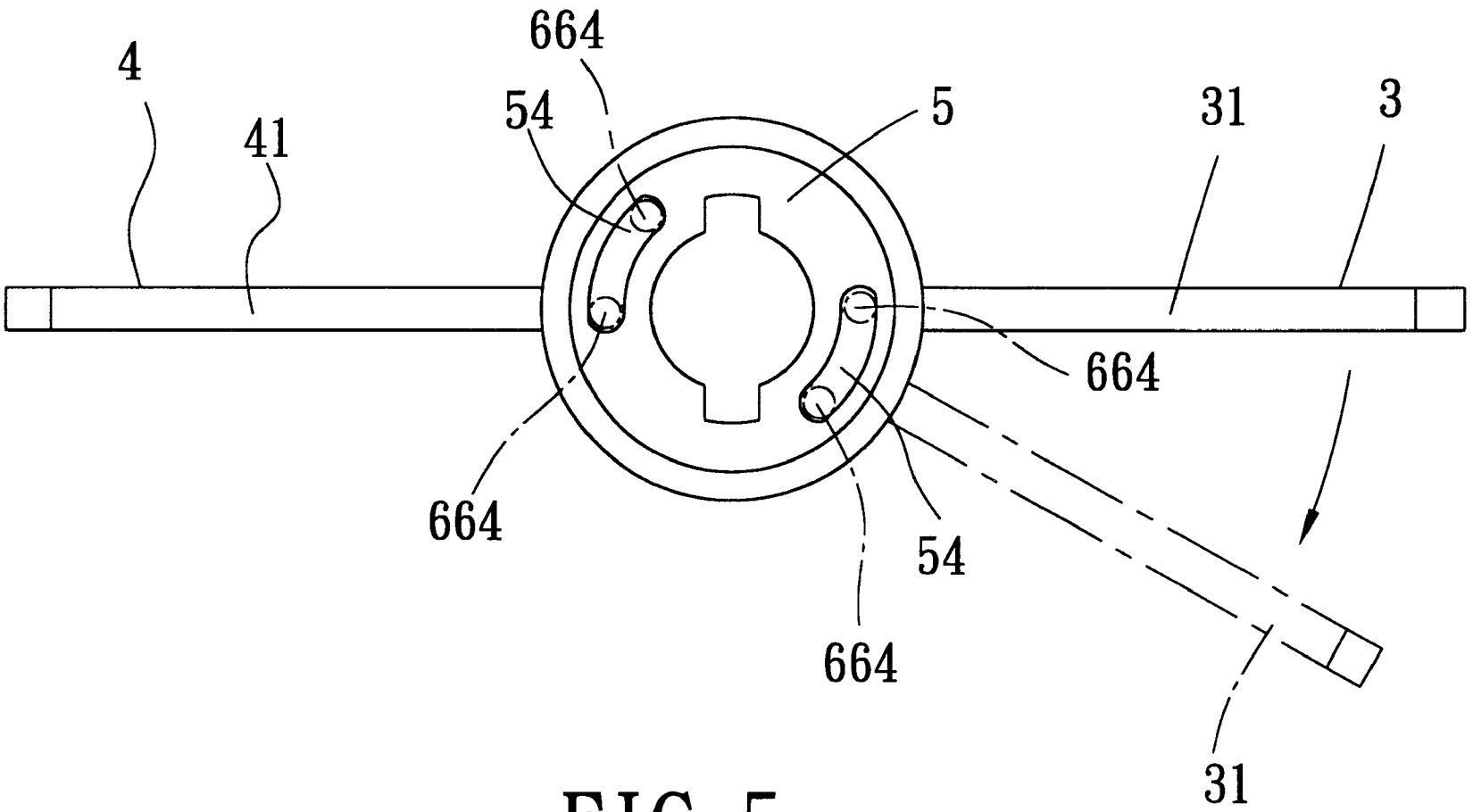
FIG. 5 illustrates movement of the restricting studs of the rotatable cam element along the restricting slots for providing the retarding action during closing movement of the preferred embodiment.

As illustrated, the rotatable hinge member 3 is pivoted to the stationary hinge member 4 so as to rotate about a vertical axis between open and closed positions, as best shown in FIGS. 2 and 3, respectively.

The cam mechanism includes a rotatable cam element 66 that is coupled to the rotatable hinge member 3 so as to rotate about the vertical axis together with the rotatable hinge member 3 and that is formed with a first cam face 665, and a slidable cam element 77 that is formed with a second cam face 775 associated with the first cam face 665 and that is movable in an axial direction along the vertical axis. When an external force is applied on the rotatable hinge member 3 so as to move the same from the closed position of FIG. 2 to the open position of FIG. 3, the second cam face 775 of the slideable cam element 77 moves away from the first cam face 665 because the slidable cam element 77 is cammed by the rotatable cam element 66.

The biasing member 75, such a compression spring, is connected to the slidable cam element 77 in such a manner so as to accumulate a returning force when the second cam face 775 moves away from the first cam face 665 and so as to urge the second cam face 775 toward the first cam face 665 when the external force ceases to be applied on the rotatable hinge member 3, thereby returning the rotatable hinge member 3 from the open position to the closed position.

The stationary hinge member 4 preferably includes a stationary leaf 41 adapted to be mounted on a door frame (not shown), and a hollow tubular member 42 fixed to the stationary leaf 41 and within which the rotatable cam element 66 and the slidable cam element 77 are received one above the other.

The rotatable cam element 66 includes a cylindrical portion 661 that extends in the axial direction, and that has a top end defining a top abutment face 668. The top abutment face 668 extends in a transverse direction relative to the vertical axis. The cylindrical portion 661 is further formed with two opposing V-shaped notches 666 which extend inclinedly and downwardly from the top abutment face 668 and which cooperatively define the first cam face 665.

The slidable cam element 77 includes a cylindrical portion 771 that extends in the axial direction, and that is disposed above the cylindrical portion 661 of the rotatable cam element 66. The cylindrical portion 771 has a bottom abutment face 778 extending in the transverse direction. The cylindrical portion 771 of the slidable cam element 77 is formed with two opposing V-shaped notches 777 which extend inclinedly and upwardly from the bottom abutment face 778 and which cooperatively define the second cam face 775. The top and bottom abutment faces 668, 778 of the rotatable and slidable cam elements 66, 77 abut and push against each other by the returning force of the biasing member 75 when the rotatable hinge member 3 rotates from the open position to a stationary position, thereby permitting positioning of the rotatable hinge member 3 stationarily relative to the stationary hinge member 4.

A guide tube 51 is mounted securely within the tubular member 42 via a fastener pin 55 to define an element-receiving chamber 510, within which the rotatable and slidable cam elements 66, 77 are received. The guide tube 51 has a top end 511, and is formed with two opposing guide grooves 53 that extend from the top end 511 and that communicate with the element-receiving chamber 510. The cylindrical portion 771 of the slidable cam element 77 has two radially and outwardly extending guide studs 73 that respectively project into the guide grooves 53 so as to ensure sliding movement of the slidable cam element 66 in the axial direction.

A rotatable connecting member 64 is disposed in the tubular member 42 below the rotatable cam element 66, and includes a cylindrical piece 641 that has top and bottom ends, and a top annular flange 643 projecting radially and outwardly from the top end of the cylindrical piece 64 and abutting against a bottom end of the cylindrical portion 661 of the rotatable cam element 66. The cylindrical piece 641 is formed with a non-circular spring-mounting recess 645 that extends inwardly from the top end of the cylindrical piece 641 in the axial direction. An urging member 65, such as a biasing spring, is mounted in the spring-mounting recess 645. The rotatable cam element 66 further includes a non-circular reduced portion 662 that projects axially from the bottom end of the cylindrical portion 661 and into the spring-mounting recess 645 to engage the same so as to permit co-rotation of the connecting member 64 with the rotatable cam element 66, and to abut against the urging member 65 so as to provide a buffering action for counter-acting the returning force of the biasing member 75 when the rotatable hinge member 3 is moved from the open position to the closed position. Under this condition, banging of the door relative to the door frame can be avoided during the door closing operation.

The guide tube 51 has a bottom end 512, and is further formed with two opposing arcuate restricting slots 54 that extend from the bottom end 512 in the axial direction. The rotatable cam element 66 further includes an annular flange 663 that extends radially and outwardly from the bottom end of the cylindrical portion 661 and that is exposed from the bottom end 512 of the guide tube 51, and a pair of opposing restricting studs 664 that project from the annular flange 663 toward the bottom end 512 of the guide tube 51 in such a manner that the restricting studs 664 are offset from the restricting slots 54 when the rotatable hinge member 3 is disposed at the closed position and that the restricting studs 664 are respectively aligned with and are urged by the urging member 65 to extend into the restricting slots 54 when the rotatable hinge member 3 is disposed at either of the open and stationary positions. Each of the studs 664 is positioned at one end of a respective one of the restricting slots 54 (see FIG. 5) when the rotatable hinge member 3 is positioned at the stationary position, and is moved from said one end to the other end of the respective one of the restricting slots 54 when the rotatable hinge member 3 is moved from the stationary position toward the closed position. During this time, the top and bottom abutment faces 668, 778 disengage from each other to permit rotation of the rotatable cam element 66, which is stopped, when the restricting studs 664 are moved to the other end of the respective one of the restricting slots 54, and which starts moving axially until the restricting studs 664 disengage the restricting slots 54, thereby permitting restoring of the rotatable cam element 66 until the returning force is fully counteracted by the urging member 65 so as to position the rotatable hinge member 3 at the closed position.

Preferably, the rotatable hinge member 3 includes a rotatable leaf 31 adapted to be fixed on the door, and vertically spaced apart annular upper and lower couplers 32, 33 that are fixed to the rotatable leaf 31 and that sandwich the tubular member 42 of the stationary hinge member 4 therebetween. The lower coupler 33 is formed with a non-circular mounting hole 331. The bottom end 642 of the cylindrical piece 641 is formed with an inner threaded hole 644 that is in spatial communication with the non-circular spring-mounting recess 645. The bottom end 642 of the cylindrical piece 641 is non-circular in cross section, and extends into and engages the mounting hole 331 of the lower coupler 33 so as to permit co-rotation of the rotatable hinge member 3 and the rotatable cam element 66 via the rotatable connecting member 64. A screw bolt 68 is inserted threadedly from an exterior of the lower coupler 33 to engage the inner threaded hole 644 of the cylindrical piece 641 so as to retain the bottom end 642 of the cylindrical piece 641 in the mounting hole 331 of the lower coupler 33.

Preferably, the tubular member 42 in this embodiment has top and bottom inner threaded ends 422, 423. A pair of upper bearing units 71, 72 sandwich opposite sides of the upper coupler 32. A pair of lower bearing units 62, 63 is disposed in the tubular member 42 between the top annular flange 643 of the rotatable connecting member 64 and the lower coupler 33. A lower bearing-positioning member 69 is sandwiched between the lower bearing units 62, 63, and has a bottom flange 691 sandwiched between the bottom inner threaded end 423 of the tubular member 42 and one of the lower bearing units 62 which abuts against the lower coupler 33, and a reduced threaded portion 692 that projects from the bottom flange 691 and that threadedly engages the bottom inner threaded end 423 of the tubular member 42 in such a manner that the reduced threaded portion 692 cooperates with the top annular flange 643 of the cylindrical piece 641 to sandwich the other one of the lower bearing units 63 therebetween. The screw bolt 68 extends through the lower bearing-positioning member 69 so as to facilitate rotation of the rotatable hinge member 3 relative to the stationary hinge member 4.

The urging member 65 abuts against the reduced portion 662 of the rotatable cam element 66 and the screw bolt 68 in such a manner that tightening and loosening of the screw bolt 68 relative to the cylindrical piece 641 results in adjustment of the buffering action for counteracting the returning force of the biasing member 75.

An upper bearing-positioning member 79, in the form of a hollow tube, is mounted threadedly on the top inner threaded end 422 of the tubular member 42, and has a radially and outwardly extending bearing-retention flange 791. The upper bearing units 71,72 are sleeved around the upper bearing-positioning member 79 in such a manner that the bearing-retention flange 791 cooperates with the upper coupler 32 to sandwich one of the upper bearing units 71 therebetween, and that the top inner threaded end 422 of the tubular member 42 cooperates with the upper coupler 32 to sandwich the other one of the upper bearing units 72 therebetween.

Preferably, the biasing member 75 includes a hydraulic cylinder 751 mounted securely in the tubular member 42 via a fastener pin 755, and extending into the upper bearing-positioning member 79 so as to enhance positioning of the hydraulic cylinder 751 in the tubular member 42. The hydraulic cylinder 751 has a piston 752 secured to a top end of the slidable cam element 77 so as to be movable in the axial direction for permitting accumulation of the returning force and restoration of the rotatable hinge member 3 to the closed position from the open position, and an adjustable knob 753 that projects from one end of the hydraulic cylinder 751 which is opposite to the piston 752 and that is movable inward and outward of the hydraulic cylinder 751 for adjusting an inner pressure inside the hydraulic cylinder 751. An adjustment bolt 76 is mounted threadedly in the upper bearing-positioning member 79, and contacts the adjustable knob 753 such that movement of the adjustment bolt 76 in the upper bearing-positioning member 79 changes the magnitude of the returning force to be applied to the slidable cam element 77.

Figure 6:
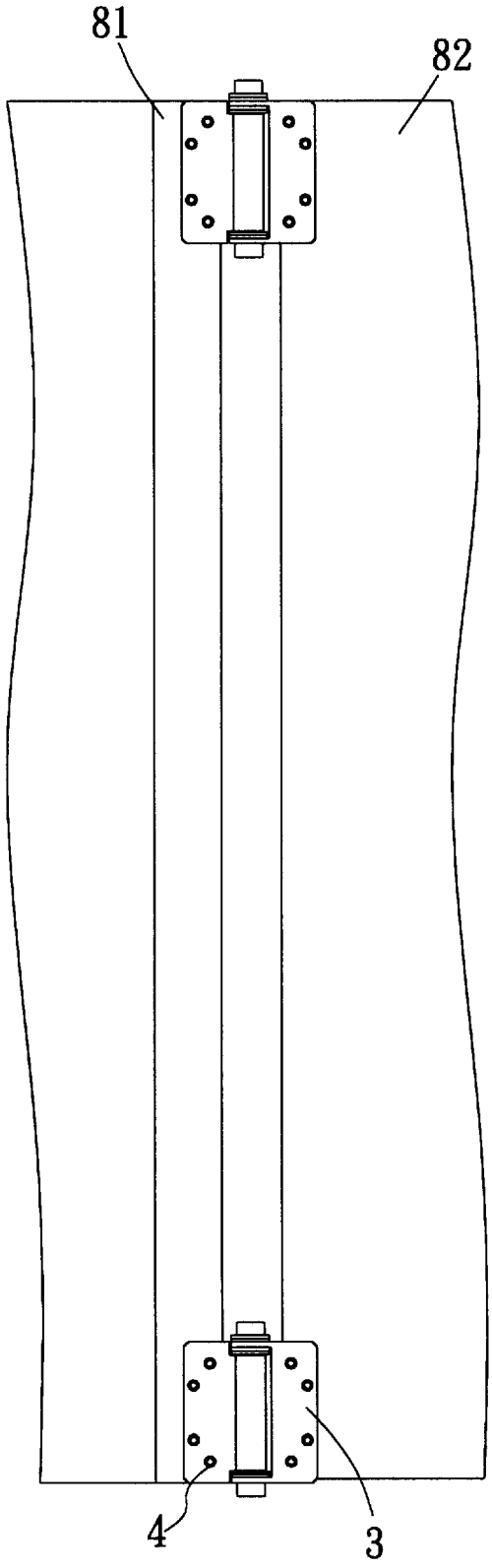
FIG. 6 illustrates how a door is mounted on a door frame by using two hinge devices of the preferred embodiment of the present invention.

FIG. 6 shows how a door 82 is mounted on a door frame 81 by using two hinge devices of the preferred embodiment.

With this invention thus explained, it is apparent that numerous modifications and variations can be made without departing from the scope and spirit of this invention. It is therefore intended that this invention be limited only as indicated by the appended claims.

I claim:

1. A hinge device comprising:

a stationary hinge member including an elongated stationary leaf, and a hollow tubular member fixed to said stationary leaf;

a rotatable hinge member pivoted to said stationary hinge member so as to be pivotable relative to said stationary hinge member about a vertical axis between a first angular position and a second angular position angularly displaced from said first angular position;

a cam mechanism including a rotatable cam element that is disposed within said tubular member, that is coupled to said rotatable hinge member so as to be pivotable relative to said stationary hinge member about said vertical axis together with said rotatable hinge member, and that is formed with a first cam face, and a slidable cam element that is disposed within said tubular member above said rotatable cam element, that is formed with a second cam face associated with said first cam face, and that is movable in an axial direction along said vertical axis, said rotatable cam element engaging said slidable cam element in such a manner that said second cam face moves away from said first cam face when said slidable cam element is cammed by said rotatable can element upon rotation of said rotatable hinge member from said first angular position to said second angular position by an external force applied on said rotatable hinge member, said rotatable cam element including a cylindrical portion extending in said axial direction, and having a top end that defines a top abutment face extending in a transverse direction relative to said vertical axis, said cylindrical portion being formed with two opposing V-shaped notches that extend inclinedly from said top abutment face and that cooperatively define said first cam face, said slidable cam element including a cylindrical portion that extends in said axial direction, that is disposed above said cylindrical portion of said rotatable cam element, and that has a bottom abutment face extending in said transverse direction, said cylindrical portion of said slidable cam element being formed with two opposing V-shaped notches that extend inclinedly from said bottom abutment face and that cooperatively define said second cam face; and a biasing member connected to said cylindrical portion of said slidable cam element so as to accumulate a returning force when said second cam face moves away from said first cam face and so as to urge said second cam face to move toward said first cam face when the external force ceases to be applied on said rotatable hinge member, thereby returning said rotatable hinge member from said second angular position to said first angular position, said top and bottom abutment faces abutting and pushing against each other by the returning force of said biasing member upon further rotation of said rotatable hinge member relative to said stationary hinge member from said second angular position to a third angular position, thereby permitting resting of said rotatable hinge member relative to said stationary hinge member at said third angular position.

2. The binge device as defined in claim 1, further comprising a guide tube disposed securely within said tubular member to define an element-receiving chamber, within which said rotatable and slidable cam elements are received, said guide tube having a top end and being formed with two opposing guide grooves that extend from said top end and that communicate with said element-receiving chamber, said cylindrical portion of said slidable cam element being formed with two guide studs that respectively project into said guide grooves so as to ensure sliding movement of said slidable cam element in said axial direction.

3. The hinge device as defined in claim 2, further comprising a rotatable connecting member disposed in said tubular member below said rotatable cam element, said connecting member including a cylindrical piece that has top and bottom ends, and a top annular flange projecting radially and outwardly from said top end of said cylindrical piece and abutting against a bottom end of said cylindrical portion of said rotatable cam element, said cylindrical piece being formed with a non-circular spring-mounting recess that extends inwardly from said top end of said cylindrical piece in said axial direction, said hinge device further comprising an urging member that is mounted in said spring-mounting recess, said rotatable cam element further including a non-circular reduced portion projecting axially from said bottom end of said cylindrical portion of said rotatable cam element and into said spring-mounting recess to engage said spring-mounting recess so as to permit co-rotation of said connecting member with said rotatable cam element, and to abut against said urging member so as to provide a buffering action for counteracting the returning force of said biasing member when said rotatable hinge member rotates relative to said stationary hinge member from said second angular position to said first angular position.

4. The hinge device as defined in claim 3, wherein said guide tube has a bottom end and is further formed with two opposing arcuate restricting slots extending from said bottom end in said axial direction, said rotatable cam element further including an annular flange that extends radially and outwardly from said bottom end of said cylindrical portion of said rotatable cam element and that is exposed from said bottom end of said guide tube, and a pair of opposing restricting studs projecting from said annular flange toward said bottom end of said guide tube in such a manner that said restricting studs are offset from said restricting slots when said rotatable hinge member is disposed at said first angular position and that said restricting studs are respectively aligned with and are urged by said urging member to extend into said restricting slots when said rotatable hinge member is disposed at either of said second and third angular positions, each of said studs being positioned at one end of a respective one of said restricting slots when said rotatable hinge member is positioned at said third angular position and being moved from said one end to the other end of the respective one of said restricting slots when said rotatable hinge member is moved from said third angular position toward said first angular position, during which said top and bottom abutment faces disengage from each other to permit rotation of said rotatable cam element, which is stopped, when said restricting studs are moved to the other end of the respective one of said restricting slots, and which starts moving axially until said restricting studs disengage said restricting slots, thereby permitting restoring of the rotation of said rotatable cam element until the returning force is fully counteracted by the urging member so as to position said rotatable hinge member at said first angular position.

5. The hinge device as defined in claim 4, wherein said rotatable hinge member includes a rotatable leaf, and vertically spaced apart annular upper and lower couplers that are fixed to said rotatable leaf and that sandwich said tubular member of said stationary hinge member therebetween, said lower coupler being formed with a non-circular mounting hole, said bottom end of said cylindrical piece being formed with an inner threaded hole that is in spatial communication with said non-circular spring-mounting recess, and being non-circular in shape, and extending into and engaging said mounting hole so as to permit co-rotation of said rotatable hinge member and said rotatable cam element via said rotatable connecting member, said hinge device further comprising a screw bolt that extends from an exterior of said lower coupler into and that threadedly engages said inner threaded hole so as to retain said bottom end of said cylindrical piece in said mounting bole of said lower coupler.

6. The hinge device as defined in claim 5, wherein said tubular member has top and bottom inner threaded ends, said hinge device further comprising a pair of upper bearing units sandwiching opposite sides of said upper coupler, a pair of lower bearing units disposed in said tubular member between said top annular flange of said rotatable connecting member and said lower coupler, and a lower bearing-positioning member sandwiched between said lower bearing units, said lower bearing-positioning member having a bottom flange sandwiched between said bottom inner threaded end of said tubular member and one of said lower bearing units which abuts against said lower coupler, and a reduced threaded portion projecting from said bottom flange and threadedly engaging said bottom inner threaded end of said tubular member so as to cooperate with said top annular flange of said rotatable connecting member to sandwich the other one of said lower bearing units therebetween, said screw bolt extending through said lower bearing-positioning member so as to facilitate rotation of said rotatable hinge member relative to said stationary hinge member.

7. The hinge device as defined in claim 6, wherein said urging member abuts against said non-circular reduced portion of said rotatable cam element and said screw bolt in such a manner that tightening and loosening of said screw bolt relative to said cylindrical piece results in adjustment of the buffering action for counteracting the returning force of said biasing member.

8. The hinge device as defined in claim 7, further comprising an upper bearing-positioning member in the form of a hollow tube mounted threadedly on said top inner threaded end of said tubular member, and having a bearing-retention flange, said upper bearing units being sleeved around said upper bearing-positioning member in such a manner that said bearing-retention flange cooperates with said upper coupler to sandwich one of said upper bearing units therebetween, and that said top inner threaded end of said tubular member cooperates with said upper coupler to sandwich the other one of said upper bearing units therebetween.

9. The hinge device as defined in claim 8, wherein said biasing member includes a hydraulic cylinder disposed securely in said tubular member and extending into said upper bearing-positioning member, said hydraulic cylinder having a piston secured to said slidable cam element and movable in said axial direction for permitting accumulation of the returning force and restoration of said rotatable hinge member to said first angular position, and an adjustable knob that projects from one end of said hydraulic cylinder which is opposite to said piston and that is movable inward and outward of said hydraulic cylinder for adjusting an inner pressure inside said hydraulic cylinder, said hinge device further comprising an adjustment bolt mounted threadedly in said upper bearing-positioning member for contacting said adjustable knob such that movement of said adjustment bolt in said upper bearing-positioning member changes magnitude of the returning force to be applied to said slidable cam element.

* * * * *